United States Patent [19]

Weitzel et al.

[11] Patent Number: 5,045,886

[45] Date of Patent: Sep. 3, 1991

[54] DEVICE FOR IMPROVING MIXING IN A MAGNETIC BRUSH DEVELOPMENT APPARATUS

[75] Inventors: Richard A. Weitzel; Larry W. Speer, both of Hilton; Susan P. Westbrook, Fairport, all of N.Y.

[73] Assignee: Eastman Kodak Company, Rochester, N.Y.

[21] Appl. No.: 444,256

[22] Filed: Dec. 1, 1989

[51] Int. Cl.[5] ..... G03G 15/09

[52] U.S. Cl. ..... 355/253; 118/657; 355/245

[58] Field of Search ..... 355/251, 252, 253, 260, 355/259, 245; 118/656, 657, 658

[56] References Cited

U.S. PATENT DOCUMENTS

| | | | |
|---|---|---|---|
| 4,261,290 | 4/1981 | Yamashita et al. | 355/253 X |
| 4,481,903 | 11/1984 | Haberhauer et al. | 355/245 X |
| 4,634,286 | 1/1987 | Pike | 355/245 X |
| 4,671,207 | 6/1987 | Hilbert | 118/657 X |
| 4,707,107 | 11/1987 | Joseph | 355/253 |
| 4,878,089 | 10/1989 | Guslits et al. | 355/253 |

*Primary Examiner*—Fred L. Braun
*Attorney, Agent, or Firm*—Lawrence P. Kessler

[57] ABSTRACT

A magnetic brush development apparatus for applying developer material to a latent electrostatic image wherein the mixing of pigmented marking particles in the developer material is enhanced. The development apparatus includes a housing having a portion defining a sump adapted to contain a supply of developer material to which marking particles may be selectively added. A magnetic brush is located substantially within the housing in spaced relation to the sump portion for applying developer material to the latent image. A feed mechanism, located within the housing between the sump portion and the magnetic brush transports developer material from the sump to the magnetic brush. An agitating and transporting mechanism, located in said sump portion, agitates developer material and transports developer material to the feed mechanism. In order to enhance the mixing of developer material, flow of developer material is directed from the wall of the housing adjacent to the sump portion back into the agitating and transport mechanism.

5 Claims, 2 Drawing Sheets

DEVICE FOR IMPROVING MIXING IN A MAGNETIC BRUSH DEVELOPMENT APPARATUS

RELATED APPLICATIONS

This application is related to U.S. applications Ser. No. 444,258, entitled DEVICE FOR PREVENTING ESCAPE OF AIRBORNE PARTICULATE MATERIAL FROM A MAGNETIC BRUSH DEVELOPMENT APPARATUS, filed on even date in the name of Westbrook et al; Ser. No. 444,210 entitled IMPROVED REPLENISHMENT DEVICE FOR A MAGNETIC BRUSH DEVELOPMENT APPARATUS, filed on even date in the name of Westbrook et al; Ser. No. 444,209 entitled IMPROVED TAKE-OFF SKIVE MOUNTING FOR A MAGNETIC BRUSH DEVELOPMENT APPARATUS, filed on even date in the name of Speer et al; and Ser. No. 444,257 entitled DEVICE FOR AIDING IN MEASURING PIGMENTED MARKING PARTICLE LEVEL IN A MAGNETIC BRUSH DEVELOPMENT APPARATUS, filed on even date in the name of Speer.

BACKGROUND OF THE INVENTION

The present invention relates in general to magnetic brush development apparatus for applying developer material to a latent image in an electrostatographic reproduction apparatus, and more particularly to a magnetic brush development apparatus including a device for improving the mixing of replenished pigmented marking particles and developer material.

Magnetic brush development apparatus for applying developer material to a latent image in an electrostatographic reproduction apparatus are well known in the art. Such apparatus may include a housing having a sump portion which contains a supply of developer material. When the developer material comprises a mixture of magnetic carrier particles and smaller pigmented marking particles, the material in the sump is agitated to triboelectrically charge the material prior to delivering it to a magnetic brush where it can be brought into association with, and transferred to, an electrostatic latent image to develop such image.

Copending, commonly assigned U.S. Pat. No. 4,887,132, issued Dec. 12, 1989 in the names of Joseph et al, and U.S. Pat. No. 4,671,207, issued June 9, 1987, in the name of Hilbert disclose magnetic brush development apparatus particularly suitable for use with developer material having pigmented marking particles and permanent magnetic carrier particles, such as disclosed in U.S. Pat. No. 4,546,060, issued Oct. 8, 1985, in the names of Miskinis et al. More particularly, the disclosed apparatus include a ribbon blender that is used for agitating (mixing), feeding and triboelectrically charging such material in the sump portion of a magnetic brush development apparatus, and a feed mechanism that delivers material from the sump portion to a magnetic brush. The ribbon blender is constructed to provide uniform flow distribution of developer material across the length of the apparatus so that a sufficient supply of material is delivered to the magnetic brush over its full extent to uniformly develop the entire latent electrostatic image. It has been found that under certain conditions the mixing of replenished pigmented marking particles and developer material does not completely occur. That is, the marking particles do not charge sufficiently to disperse and adhere to the carrier particles in the developer material in the sump of the development apparatus. This may result in the generation of unacceptable artifacts in the developed image.

SUMMARY OF THE INVENTION

This invention is directed to a magnetic brush development apparatus for applying developer material to a latent electrostatic image wherein the mixing of pigmented marking particles in the developer material is enhanced. The development apparatus includes a housing having a portion defining a sump adapted to contain a supply of developer material to which marking particles may be selectively added. A magnetic brush is located substantially within the housing in spaced relation to the sump portion for applying developer material to the latent image. A feed mechanism, located within the housing between the sump portion and the magnetic brush transports developer material from the sump to the magnetic brush. An agitating and transporting mechanism, located in said sump portion, agitates developer material and transports developer material to the feed mechanism. In order to enhance the mixing of developer material, flow of developer material is directed from the wall of the housing adjacent to the sump portion back into the agitating and transport mechanism.

The invention, and its objects and advantages, will become more apparent in the detailed description of the preferred embodiment presented below.

BRIEF DESCRIPTION OF THE DRAWINGS

In the detailed description of the preferred embodiment of the invention presented below, reference is made to the accompanying drawings, in which.

DETAILED DESCRIPTION OF THE INVENTION

Figure 1:
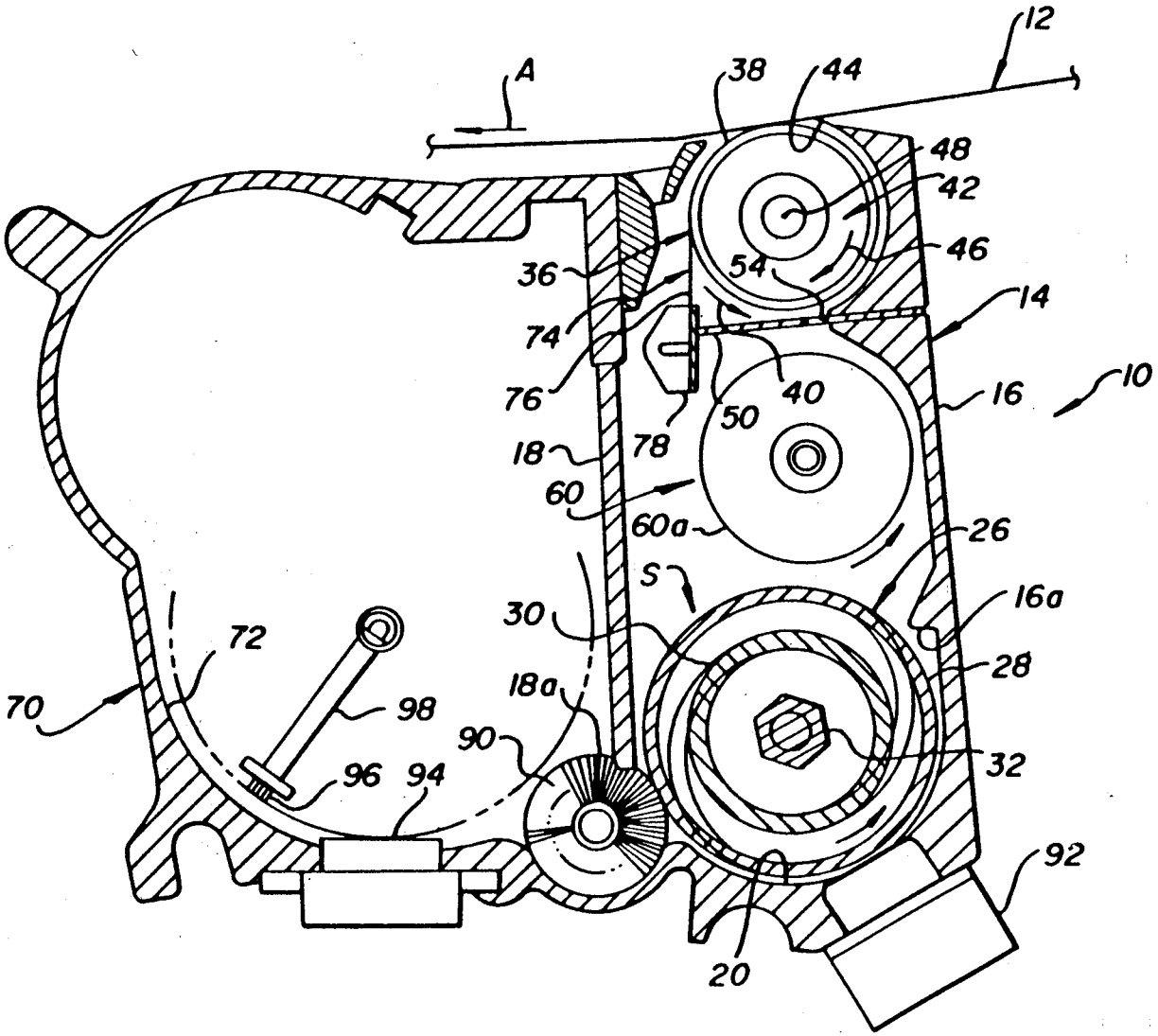
FIG. 1 is an end elevational view, partly in cross-section, of the improved magnetic brush development apparatus according to the present invention.

Referring now to the accompanying drawings, FIG. 1 shows an improved magnetic brush development apparatus according to this invention, generally designated by the numeral 10. The apparatus 10 is adapted to provide a supply of developer material, including pigmented marking particles and carrier particles, to an electrostatic latent image carried by a member 12 in order to develop the latent image on the member with the marking particles. The member 12, which is for example part of an electrostatographic reproduction apparatus, is in the form of an endless web or a drum, or can be discrete sheets on which a reproduction is formed. The member 12 is moved past apparatus 10 in the direction shown by the arrow A during development of the latent image on the member.

Apparatus 10 comprises a housing 14 having spaced, generally parallel, substantially vertical side walls 16, 18; a generally semi-cylindrical bottom wall 20 that joins the side walls; and end walls (not shown). The lower portion of the housing defines a sump S for containing a supply of developer material. The developer material can be of any known type, for example including two-component developer material comprising hard, permanent magnetic carrier particles and pigmented marking particles, such as disclosed in the aforementioned U.S. Pat. No. 4,546,060.

Developer material in sump S is agitated in order to mix the marking particles and carrier particles, provide triboelectric charging of the developer material, move the material along the length of the sump, and deliver developer material to a feed mechanism 60. Such agitation is effected by a ribbon blender generally designated by the numeral 26, such as disclosed in the aforementioned U.S. Pat. No. 4,887,132, or U.S. Pat. No. 4,671,207. The ribbon blender 26 comprises an outer helical ribbon 28 and an inner helical ribbon 30. Both ribbons are coiled concentrically about a shaft 32. Shaft 32 is, in turn, concentrically located with respect to the semi-cylindrical bottom wall 20 of the housing 14, and runs for substantially the full length thereof. The ribbons 28, 30 rotate with the shaft 32. Ribbon 28 may have the same pitch throughout its length, or may have one pitch over half its length and the opposite pitch over the other half of its length. The pitch orientation of ribbon 30 is selected to be opposite to the pitch orientation of ribbon 28. When the shaft 32 is rotated in a counterclockwise direction as viewed in FIG. 1, the ribbons move developer material in sump S in a counterclockwise direction, as well as a direction from the front of the housing 14 toward the rear, and then from the rear of the housing toward the front. This results in significant agitation and shearing of the developer material in order to triboelectrically charge the material.

Under certain conditions, such as when fresh marking particles are added to the developer material in the sump S in the manner described below, the marking particles may not adequately mix with the carrier particles before delivery to the feed mechanism 60. As a result of inadequate mixing, marking particles may be left uncharged or may only be charged to a low level insufficient to function in the desired manner during development of the latent electrostatic image on the member 12. This may result in formation of airborne marking particles which can escape from the development station, and artifacts in a finished reproduction due to incomplete development. In order to enhance mixing, a protuberance **16*a* is formed on the wall 16 of the development station housing 14 adjacent to the ribbon blender 26 upstream of the feed mechanism 60. The protuberance 16*a*, which runs substantially the full length of the housing 14, directs flow of developer material (particularly any replenished marking particles) from the wall of the housing adjacent to the sump portion back into the ribbon blender (i.e., in a direction having a component toward the longitudinal axis of the blender) thereby creating turbulence in the developer material being agitated by the ribbon blender to effectively extend the mixing path for the material. This gives the marking particles more time to disperse within the developer material and adequately charge before being picked up and fed by the mechanism 60 to the magnetic brush 36**. Accordingly, the amount of uncharged (or low charged) marking particles is substantially reduced thereby concomitantly reducing undesirable airborne marking particles.

A magnetic brush, generally designated by the numeral 36, is located at the top of housing 14. The magnetic brush 36 may be of any suitable construction, such as illustrated for example in FIG. 1, where the magnetic brush includes a shell 38 of a non-magnetic material that rotates counterclockwise as indicated by arrow 40 about a core 42. Core 42 comprises a plurality of permanent magnets rotatable in a clockwise direction as shown by arrow 46. The axis of rotation of the core, coincident with the axis of rotation of the shell, is designated generally by the numeral 48. A portion of the magnetic brush 36 projects through the top of the housing 14 and lies directly underneath the electrostatic latent image carrying member 12.

Immediately beneath the magnetic brush 36 is a feed mechanism generally designated by the numeral 60. The feed mechanism 60 includes a metering assembly 50 having a plate defining an elongated feed slot 54 that extends substantially the full length of the magnetic brush and lies adjacent to the outer surface of the magnetic brush shell 38. Developer material received from the lower portion of the housing 14 passes through slot 54 to the brush 36, such material being attracted to the outer surface of shell 38 by the magnets in the core 42 of the magnetic brush. A transport assembly **60*a* for the feed mechanism 60 is located between metering assembly 50 and the ribbon blender 26. The transport assembly 60*a* receives developer material from the sump S and the ribbon blender 26, and transports such material to the metering assembly 50 and through the slot 54 to the magnetic brush 36. The transport assembly 60*a* comprises, for example, a shell rotatable in a counterclockwise direction shown by the arrow with a plurality of stationary magnets that extend counterclockwise from a position generally directly above the ribbon blender 26 to a position just ahead of the feed slot 54 (approximately 160 degrees). Developer material from the sump is attracted to the shell and held to the shell in the area under the influence of the magnets. Thus the material can be transported from the sump to the slot 54** without dropping from the shell.

In operation, developer material provided to the magnetic brush 36 is carried by the shell 38 into operative contact with the latent image carrying member 12 for developing an electrostatic latent image on the image bearing member with pigmented marking particles in a development zone between the brush and the member. Even with the improved developer material mixing described above, some percentage of the marking particles are not charged (or have low charge) and become airborne. As noted, these particles can cause image artifacts or may exit the development apparatus 10 to cause contamination within the reproduction apparatus or its environment. In order to substantially prevent escape of the airborne marking particles from the development apparatus 10, a contamination control flap 44 is provided. The flap 44 is a thin flexible member fixed to the housing 14 upstream of the development zone. The connection of the flap 44 to the housing 14 is effected such that the flap extends into the path of the latent image carrying member 12, and is oriented at an angle with respect to the member to effect engagement of the flap with the member under a minimal engagement force. In this manner damage to the member 12 or undue wear of the flap 44 is minimized. The flap 44 then serves as a seal between the development apparatus 10 and the member 12. Accordingly, any airborne marking particles are trapped and forced into the developer nap of the development zone. In such zone, the marking particles are charged and become part of the developed image, or are returned with the excess developer material exiting the development zone. In this manner, escape of the airborne marking particles is substantially prevented and build up of uncharged marking particle within the development apparatus 10 is greatly reduced.

Figure 3:
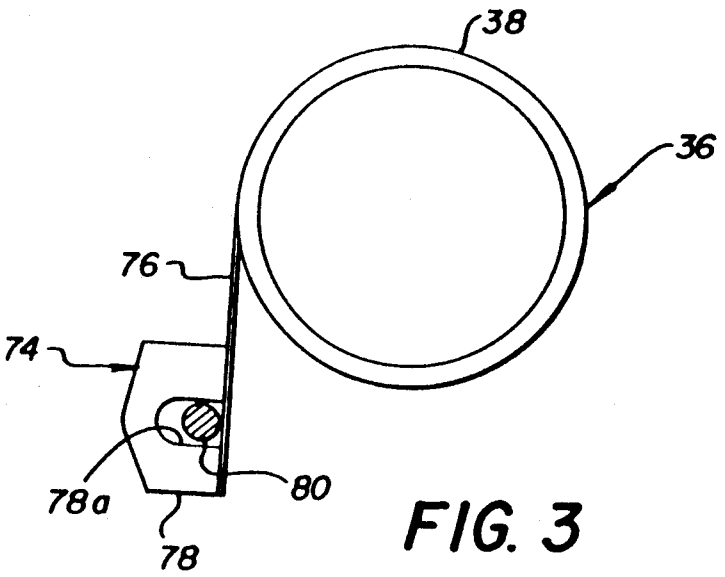
FIG. 3 is an end elevational view, on an enlarged scale, of the take-off skive mounting device for the magnetic brush development apparatus shown in FIG. 1.
Figure 4:
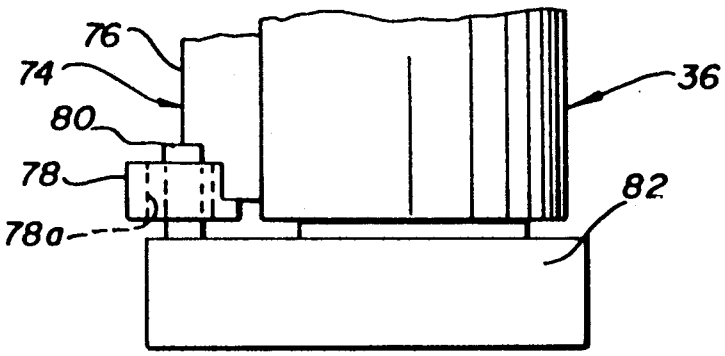
FIG. 4 is a top plan view of a portion of the take-off skive mounting device for the magnetic brush development apparatus shown in FIG. 1.

After development of the latent image with marking particles by the magnetic brush 36, continued rotation of the shell 38 of the magnetic brush brings the developer material remaining on the shell to a take-off skive 74 for scraping the material from the shell. The removed material returns by gravity to the sump S where it is remixed by the ribbon blender 26 with developer material remaining in the sump. The take-off skive 74 includes an elongated blade 76 for removing developer material passing through the development zone, from the shell 38. The blade 76 is attached to mounting members 78 (one shown in the drawings). As best shown in FIGS. 3 and 4, the mounting members 78 define slots 78*a* which are adapted to receive pins 80 respectively extending from end blocks 82 supporting the magnetic brush 36 whereby the take-off skive is capable of limited self-adjusting movement. The slots 78*a* are oriented so that the limited movement of the take-off skive 74, for any particular development apparatus, automatically defines a position for the skive determined by the plate of the metering assembly 50 (engaged by the members 78) and the contour of the shell 38 (engaged by the blade 76). In operation, the blade 76 is held in contact with the shell 38 by developer material scraped off of the shell. That is, the field of the magnets of the core 42 act to attract the developer material on the blade pulling the blade into intimate contact with the shell. By utilizing the magnetic properties of the developer material and the slotted mounting of the take-off skive to properly position the skive blade 76 against the shell 38, a lower torque is established for the magnetic brush 36 than with prior take-off skive mounting arrangements employing positive forces for blade/shell engagement. The lower torque is particularly significant in that it serves several purposes. It reduces heat generated by the development apparatus, wear to the blade of the skive, and the amount of flakes produced between the blade and the shell.

Figure 2:
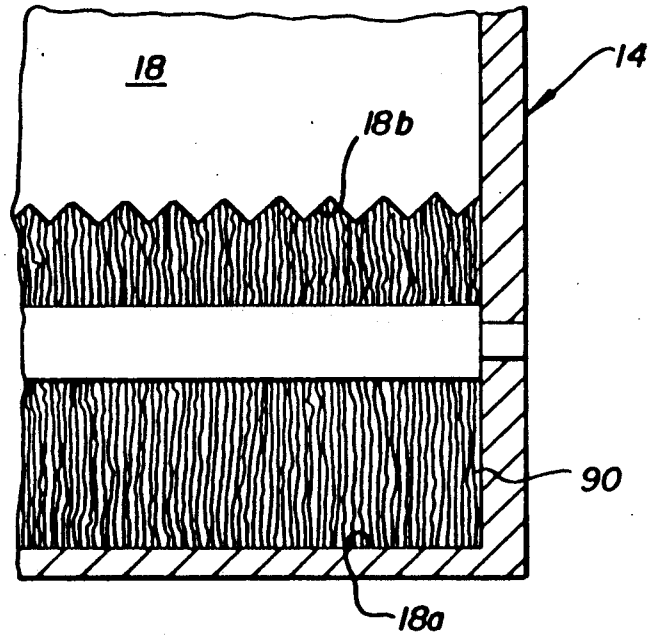
FIG. 2 is a side elevational view, on an enlarged scale, of a portion of the replenishment skive wall of the magnetic brush development apparatus shown in FIG. 1.

Since material returned from the magnetic brush 36 will be partially depleted of marking particles (used up in the development of electrostatic latent images), fresh marking particles must be periodically provided to the sump S to replenish the developer material. To this end, a replenishment system 70 is located at one side of the housing 14 adjacent to the side wall 18. The replenishment system 70 includes a reservoir 72 for storing a supply of marking particle replenishment material. The common wall 18 defines an opening 18*a* which provides a flow communication path between the marking particle reservoir 72 and the sump S. A fibrous replenishment brush 90 is rotatably mounted in the bottom of the reservoir 72 adjacent to the opening 18*a*, the fibers of the brush extending through the opening. The replenishment brush 90, when not rotating acts to seal the opening to prevent marking particles from flowing from the reservoir to the sump. However, when the concentration of marking particles in the developer material in the sump (as determined by any well known concentration monitor for example shown in FIG. 1 as mechanism 92) falls below a desired level for adequate latent image development, the replenishment brush 90 is selectively rotated to feed a quantity of fresh marking particles from the reservoir to the sump. The portion of the wall 18 forming the marginal edge 18*b* of the opening 18*a* has a saw-toothed configuration (see FIG. 2). When the brush 90 is rotated in a counterclockwise direction, the saw-toothed configuration acts to readily comb marking particles out of the fibers of the replenishment brush. When compared to straight walls found in replenishment systems of prior development apparatus, the saw-toothed configuration reduces the area in heavy contact with the the brush fiber, concomitantly reducing the torque required to rotate the replenishment brush. As a result of this torque reduction, the tolerance for locating the replenishment brush 90 relative to the opening 18*a* is significantly expanded. This, in turn, broadens the set up latitude for the replenishment brush under which acceptable replenishment rates can be accomplished without producing unacceptably high torque levels.

The replenishment system 70 also includes an improved mechanism for sensing the level of marking particles in the reservoir 72. The level sensing mechanism includes a sensor 94 mounted at the bottom of the replenishment system housing in a substantially horizontal orientation. Such orientation is necessary to properly provide an "out of marking particles" signal where the marking particles are fed from the reservoir near one side at the bottom as shown in FIG. 1 of the drawings. For the sensor 94 to function properly, a wiper 96 is attached to the the outboard end of a rotatable marking particle agitator 98 within the reservoir. The length of the agitator 98 and the size of the wiper 96 are selected such that the wiper sweeps marking particles from the face of the sensor 94 toward the replenishment brush 90 as the agitator is rotated in a counterclockwise direction. As the agitator 98 passes the sensor 94, the marking particles back fill behind the wiper 96 to recover the sensor. When there is not enough marking particles to fill in after passage of the agitator, the sensor will detect that the "out of marking particles" condition exists and produce the appropriate warning signal. In this manner, marking particle level sensing is consistently assured.

The invention has been described in detail with particular reference to a preferred embodiment thereof, but it will be understood that variations and modifications can be effected within the spirit and scope of the invention as described hereinabove and as defined in the appended claims.

We claim:

1. In an improved development apparatus for applying developer material to a latent image on a moving image carrying member, said apparatus including a housing having a wall portion defining a sump adapted to contain a supply of developer material, applicator means located substantially within said housing in spaced relation to said sump portion for applying developer material to the latent image, feed means located within said housing between said sump portion and said applicator means for transporting developer material from said sump portion to said applicator means, and a ribbon blender located in said sump portion below said feed means, said ribbon blender being rotatable about its longitudinal axis for agitating developer material and transporting developer material to said feed means, the improvement comprising:

means, located in said housing adjacent to said sump portion, for directing flow of developer material away from the wall of said housing toward the longitudinal axis of said ribbon blender to enhance developer material mixing in said housing.

2. The invention of claim 1 wherein said flow directing means is located upstream of said feed means.

3. The invention of claim 2 wherein said flow directing means comprises a protrusion attached to the internal wall of said housing extending toward said ribbon blender.

4. An improved magnetic brush development apparatus for applying developer material to a latent image on a moving image carrying member, said apparatus comprising:

a housing having a wall portion defining a sump adapted to contain a supply of developer material; means for selectively replenishing material in said sump portion; a magnetic brush located substantially within said housing in spaced relation to said sump portion for applying developer material to the latent image; a feed mechanism located within said housing between said sump portion and said magnetic brush for transporting developer material from said sump to said magnetic brush; a ribbon blender located in said sump portion below said feed mechanism, said ribbon blender being rotatable about its longitudinal axis for agitating developer material and transporting developer material to said feed mechanism; and means, located in said housing downstream of said replenishment means and upstream of said feed mechanism, for directing flow of developer material away from the wall of said housing toward the longitudinal axis of said ribbon blender to enhance developer material mixing in said housing.

5. The invention of claim 4 wherein said flow directing means comprises a protrusion attached to the internal wall of said housing extending toward said ribbon blender.

* * * * *